United States Patent [19]

Davies

[11] Patent Number: 4,493,520

[45] Date of Patent: Jan. 15, 1985

[54] ELECTRICAL PUSH-PULL CONNECTOR

[75] Inventor: Jeffrey N. Davies, Canterbury, England

[73] Assignee: Allied Corporation, Morris Township, N.J.

[21] Appl. No.: 442,333

[22] Filed: Nov. 17, 1982

[30] Foreign Application Priority Data

Dec. 10, 1981 [FR] France ..... 81 23254

[51] Int. Cl.[3] ..... H01R 13/62

[52] U.S. Cl. ..... 339/91 P; 339/91 R

[58] Field of Search ..... 339/91 R, 91 P, 91 B, 339/45 R, 65 M, 46; 285/304, 315, 316, DIG. 7, 81, 82, 84, 86, 330

[56] References Cited

U.S. PATENT DOCUMENTS

| | | | |
|---|---|---|---|
| 3,317,220 | 5/1967 | Bruning | 285/304 |
| 3,964,771 | 6/1976 | Baudouin | 285/315 |
| 4,017,139 | 4/1977 | Nelson | 339/91 R |

FOREIGN PATENT DOCUMENTS

| | | |
|---|---|---|
| 1062786 | 9/1979 | Canada . |
| 864604 | 4/1941 | France . |
| 2159701 | 6/1973 | France . |
| 2204331 | 5/1974 | France . |
| 1548891 | 7/1979 | United Kingdom . |

*Primary Examiner*—William R. Briggs
*Attorney, Agent, or Firm*—Roger H. Criss

[57] ABSTRACT

The present invention concerns a connecting device comprising a connector having an inner sleeve and an outer cylindrical sleeve sliding axially in relation to the inner sleeve. The inner sleeve has on its outside a very wide V-shaped groove defining two ramps. The outer sleeve has a series of protuberances resting against the side walls of the groove and biased inwardly by a split ring. The protuberances may be integral with the split ring.

5 Claims, 3 Drawing Figures

FIG. 1
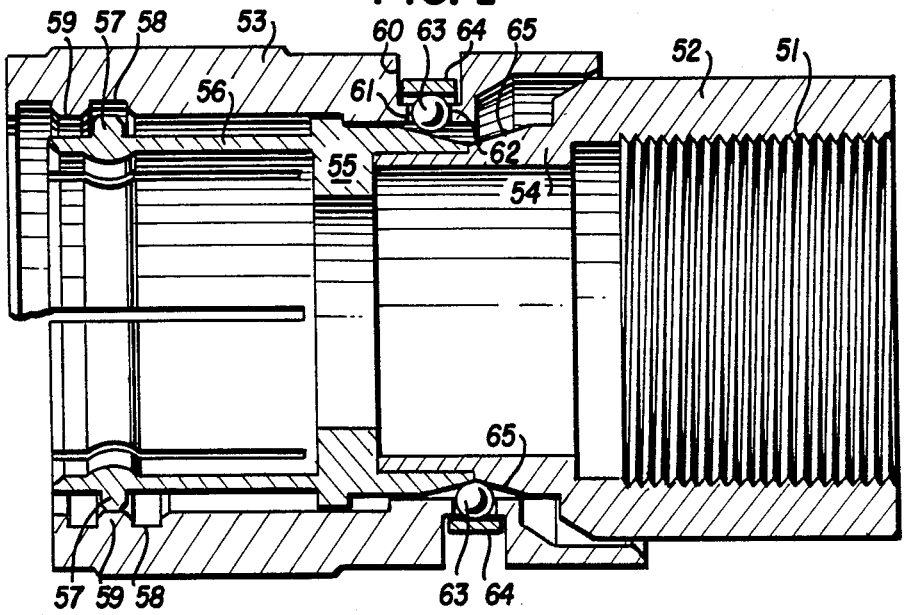
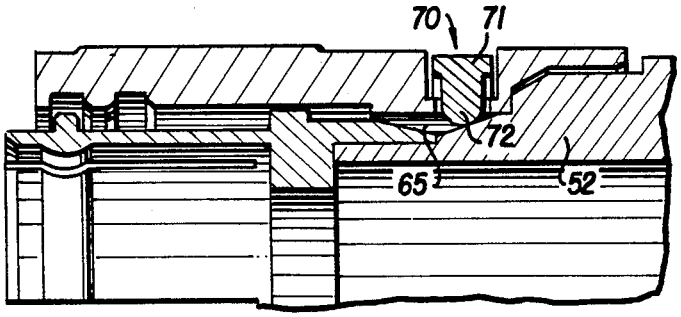
FIG. 2
FIG. 3
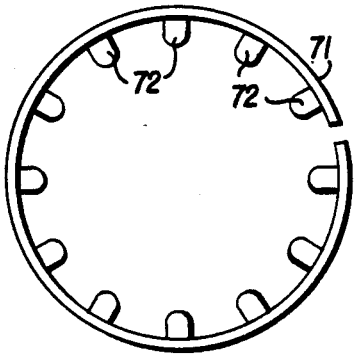

ELECTRICAL PUSH-PULL CONNECTOR

DESCRIPTION

Cross-Reference to related Applications

This application is related to the U.S. patent application, Ser. No. 420,225, filed on Sept. 7, 1982, based on PCT application No. PCT/FR82/002 filed Jan. 6, 1982.

BACKGROUND OF THE INVENTION

A push-pull connecting device useful for a coaxial cable, for example, is described in French patent application No. 81/00245 filed Jan. 7, 1981. The device therein described includes a toroidal spring which is in contact with one wall of a V-shaped groove, along a continuous circular line. When the exterior sleeve member is moved with respect to the interior sleeve member, the friction of the spring on the walls is relatively considerable.

It would be desirable to provide a device in which this friction is reduced and which utilizes standard elements at relatively modest costs.

SUMMARY OF THE INVENTION

In accordance with this invention, there is provided an electrical push-pull connector comprising a first and a second mating connector members, each having an insulating unit at least partially mounted inside a cylindrical body, and at least two electrical contact elements, the electrical contact elements of the first connector member being matable with the contact element of the second connector member, and being arranged so that they are respectively electrically connected when the first and the second connector members are mated, and mechanical means provided on the first connector member and adapted to permit the mating of the first and the second connector members, and their locking in the mating position; in which the mechanical means comprise a cylindrical exterior sleeve member, being coaxially mounted on the cylindrical body, and axially movable between a central locking position and two unlocking positions on both sides of the central locking position, a cylindrical interior sleeve member coaxially mounted on the body and having a plurality of resilient tongues extending axially towards the mating end of the first connector member, each of the tongues being provided with a first interior protrusion adapted to penetrate in an annular groove provided on the second connector member when the first and second connector members are mated, and each of the tongues being provided with a second exterior protrusion adapted to cooperate with a cam surface provided on the interior surface of the exterior axially movable sleeve member to permit the locking and the unlocking of the first and second connector members when they are mated, the exterior axially movable sleeve member having also means for bringing it back automatically into its central locking position, the means for bringing back automatically the exterior movable sleeve member into its central locking position including an open V groove provided on the peripheral surface of the body of the first connector member, the V groove being fairly wide and providing a zone of minimal diameter and two ramps provided by the lateral walls of the V groove, the width of the V groove being at least equal to the stroke of the exterior axially movable sleeve member; and spring means, mounted on the exterior axially movable sleeve member, the spring means providing a resilient ring means round the body of the first connector member, adjacent to the V groove, being biased towards its rest position where it is located in the zone of minimal diameter, and being mounted on the exterior axially movable sleeve member so that the rest position coincides with the locking position of the sleeve member, characterized in that the spring means comprise a split ring obliged by its elasticity to adopt a position in which its diameter tends to become minimal, and a series of protuberant members placed at regular intervals in contact with the interior surface of the split ring, these protuberant members leaning against one or the other of the lateral walls of the V groove provided on the peripheral wall of the interior sleeve member.

The present device contemplates a spring means having a split ring forced by its elasticity to adopt a position in which its diameter tends to become minimal, and a series of protuberant elements, placed at regular intervals in contact with the inside surface of the split ring, these protuberant elements being supported by one or the other sides of the V-shaped groove placed on the outside wall of the inner sleeve.

According to a preferred form of realization, the protuberant elements are made up of independent spherical balls, and the split ring is a flat spring of which the elastic constraints tend to tighten this ring and push the balls toward its center.

However, the protuberant elements can likewise be integral to the split ring and mounted on the inside surface of the latter. In this case, they have a rounded end to facilitate sliding on the walls of the V-shaped groove. The split ring is preferably housed in a U-shaped groove open toward the outside of the outer sleeve, and the protuberant elements are preferably engaged in the openings across the bottom of this groove, to allow the said protuberant elements to lean against the lateral walls of the V-shaped groove.

The width of the U-shaped groove is at least equal and preferably slightly more than the width of the split ring, the diameter of the protuberant elements is at least equal and preferably slightly less than the diameter of the openings located at the bottom of this groove, and the diameter of these openings is at the most equal and preferably slightly less than the width of the U-shaped groove.

BRIEF DESCRIPTION OF THE DRAWINGS

The present invention will be better understood in reference to the description of the examples and drawings attached in which:

FIG. 1 represents a cross-sectional view of a connector element according to the invention, the uppermost half of this view illustrating the connector ready to receive a complementary connector element and the lowermost half illustrating this connector element in locking position.

FIG. 2 represents a partial view of another form of realization of improvement according to the invention, and FIG. 3 is a plan view of the split ring illustrated by FIG. 2.

DESCRIPTION OF THE PREFERRED EMBODIMENTS

In reference to FIG. 1, the connector element 51 shown, has an annular body 52, referred to hereafter as inner cylindrical sleeve and an outer cylindrical sleeve 53, movable axially in relation to sleeve 52. On the inside of the inner sleeve 52 are mounted different elements (not shown) for electrical contact with a second connector, for example, as described and shown in the aforesaid U.S. patent application, the disclosure of which is expressly incorporated herein by reference. Likewise, the inner sleeve 52 is made up of essentially of an annular support 54 and an annular sleeve 55, mounted for example by screwing to the anterior end of the annular support 54. This sleeve 55 has a crown of small elastic tongues 56, mounted parallel to each other and parallel to the axis of the connector element, at the anterior end of the cylindrical sleeve 55. Each one of these small tongues has a protuberance 57, which cooperates either with an annular groove 58 arranged on the inner surface of the outer sleeve 53, or with an annular protuberance 59, adjacent to groove 58, to assure respectively the unlocking (see the upper part of FIG. 1) and the locking (see the lower part of the connector in FIG. 1) of the outer sleeve 53.

The outer sleeve 53 has in addition, a U-shaped groove 60 of which the bottom 61 is crossed by openings 62, preferably circular, arranged at regular intervals all around the inner surface of this sleeve. In the holes 62 are lodged round balls 63, the diameter of these balls being such that their upper surfaces come in contact with a flat annular spring 64, in the form of a split ring, and that their inner surfaces are resting against at least one of the side walls of the V-shaped groove 65 with which inner sleeve 52 is provided. The split ring 64 tends to push the balls back toward its center. The U-shaped groove has a width slightly less than that of the flat spring 64, in order to allow this spring to shift radially in the inside of this groove. In addition, the balls have a diameter slightly less than that of the circular openings 62, in order to allow the balls to shift radially under the action of spring 64. The openings 62 preferably have a diameter less than or equal to the width of the U-shaped groove 60.

In practice, when the operator pulls (or pushes) the outer sleeve 53 beyond its locking position (shown by the lower part of FIG. 1), the balls 63 slide or roll on one (or the other) of the side walls of groove 65, causing an extension of the flat spring 64 which arms itself. When the operator releases the outer sleeve 53, the spring leaning against the balls 63, causes a thrust which tends to return the balls to the bottom of the groove 65, drawing the outer sleeve 53 toward its locking position.

FIG. 2 represents a variation in which the flat spring 64 and the independent balls 63, have been replaced by a single piece 70 made up of, as is shown in more detail in FIG. 3, of a spring plate 71 which makes up the split ring, provided on its inner surface with protuberances 72 having rounded ends which rest against at least one of the side walls of the V-shaped groove 65 arranged on the outside of inner sleeve 52.

The protuberances 72 have the same functions as the balls 63 of the preceding example. In a similar manner, the split ring 71 has the same function as the split ring 64 of FIG. 1. The protuberances 72 can be made from one piece with the split ring 71 or may be adapted by any appropriate known means.

I claim:

1. An electrical push-pull connector comprising a first and a second mating connector members, each having an insulating unit at least partially mounted inside a cylindrical body, and at least two electrical contact elements, the electrical contact elements of said first connector member being matable with the contact element of said second connector member, and being arranged so that they are respectively electrically connected when said first and said second connector members are mated, and mechanical means provided on said first connector member and adapted to permit the mating of said first and said second connector members, and their locking in said mating position; in which said mechanical means comprise a cylindrical exterior sleeve member, being coaxially mounted on said cylindrical body, and axially movable between a central locking position and two unlocking positions on both sides of said central locking position, a cylindrical interior sleeve member coaxially mounted on said body and having a plurality of resilient tongues extending axially towards the mating end of said first connector member, each of said tongues being provided with a first interior protrusion adapted to penetrate in an annular groove provided on said second connector member when said first and second connector members are mated, and each of said tongues being provided with a second exterior protrusion adapted to cooperate with a cam surface provided on the interior surface of said exterior axially movable sleeve member to permit the locking and the unlocking of said first and second connector members when they are mated, said exterior axially movable sleeve member having also means for bringing it back automatically into its central locking position, said means for bringing back automatically said exterior movable sleeve member into its central locking position including an open V groove provided on the peripheral surface of said body of said first connector member, said V groove being fairly wide and providing a zone of minimal diameter and two ramps provided by the lateral walls of the V groove, the width of said V groove being at least equal to the stroke of said exterior axially movable sleeve member; and spring means, mounted on said exterior axially movable sleeve member, said spring means providing a resilient ring means round said body of said first connector member, adjacent to said V groove, being biased towards its rest position where it is located in said zone of minimal diameter, and being mounted on said exterior axially movable sleeve member so that said rest position coincides with the locking position of said sleeve member, characterized in that the said spring means comprise a split ring obliged by its elasticity to adopt a position in which its diameter tends to become minimal, and a series of protuberant members placed at regular intervals in contact with the interior surface of the split ring, these protuberant members leaning against one or the other of the lateral walls of the V groove provided on the peripheral wall of the interior sleeve member.

2. Device according to claim 1, characterized in that the split ring is lodged in a U-shaped groove, open toward the exterior of the outer sleeve, and in that the protuberant elements are engaged in the openings crossing the bottom of this groove to allow the said protuberant elements to lean on the lateral walls of the V-shaped groove.

3. Device according to claim 1, characterized in that the protuberant elements are mounted on the interior surface of the split ring and have a rounded end to facilitate their sliding on the walls of the V-shaped groove.

4. Device according to claim 1, characterized in that the protuberant elements are made up of the round independent balls and in that the split ring is a flat spring whose elastic forces tend to contract this ring and push the balls back toward its center.

5. Device according to claim 4, characterized in that the width of the U-shaped groove is at least equal to and preferably slightly greater than the width of the split ring, in that the diameter of the balls is at most equal to and preferably slightly less than the diameter of the openings arranged at the bottom of this groove, and in that the diameter of these openings is at most equal to and preferably slightly less than the width of the U-shaped groove.

* * * * *